United States Patent [19]

Viaud

[11] Patent Number: 5,021,007

[45] Date of Patent: Jun. 4, 1991

[54] SCREENED FLAT ELECTRIC CABLE HAVING A PLURALITY OF PARALLEL CONDUCTORS

[75] Inventor: André Viaud, Crosne, France

[73] Assignee: Filotex, Draveil, France

[21] Appl. No.: 522,878

[22] Filed: May 14, 1990

[30] Foreign Application Priority Data

May 12, 1989 [FR] France ..... 89 06267

[51] Int. Cl.[5] ..... H01R 13/00

[52] U.S. Cl. ..... 439/497

[58] Field of Search ..... 439/67, 77, 92, 108, 439/497, 607–610

[56] References Cited

U.S. PATENT DOCUMENTS 4,887,977 12/1989 Lemke ..... 439/497

*Primary Examiner*—Joseph H. McGlynn

*Attorney, Agent, or Firm*—Sughrue, Mion, Zinn, Macpeak & Seas

[57] ABSTRACT

A flat electric cable having a plurality of parallel conductors spaced apart inside insulation, and provided with screening, wherein at least one of the outer conductors projects partially from the insulation and makes contact with the screening, and the projecting outer conductor is wider than the other conductors.

2 Claims, 2 Drawing Sheets

SCREENED FLAT ELECTRIC CABLE HAVING A PLURALITY OF PARALLEL CONDUCTORS

The present invention relates to a flat electric cable having a plurality of parallel conductors spaced apart inside insulation, and provided with screening, wherein at least one of the outer conductors projects partially from the insulation and makes contact with the screening.

BACKGROUND OF THE INVENTION

Regardless of whether or not they include a drain ensuring electrical continuity for the screening, most prior screened electric cables are not suitable for having conventional connectors mounted thereon, which connectors are designed to be mounted on unscreened cables in practical and rapid manner by conventional types of connection device, in particular by using automatic machinery, since the connection devices do not provide connection with the screening of the cables at the same time as they connect with their conductors. It is therefore necessary to use special connectors which are relatively uncommon and which are connected to a cable by operations that are lengthly and expensive, and which provide connections of uncertain reliability, particularly when the cable conductors include a drain conductor.

The document U.S. Pat. No. 4,488,125 describes a flat coaxial cable provided with screening, the cable including an outer conductor projecting from one of the sides of the insulation or two outer conductors projecting from two sides of the insulation, with the, or each, projecting outer conductor making contact with the screening.

Such a cable cannot be mounted in a zero insertion force connector in compliance with conventional standards and it cannot accept the pins of staple-type connectors, whether they be longitudinal (Berg system) or transversal (AMP system), which provide both electrical contact and electric charge drainage simultaneously.

The object of the present invention is to provide a screened flat electric cable suitable for being connected to a similar cable after mere stripping by an operation that is simple and quick, using zero insertion force connectors or connectors having longitudinal or transversal staple-type pins, which connectors provide reliable connection.

SUMMARY OF THE INVENTION

In the flat screened electric cable of the invention the outer conductor projecting from the insulation and making contact with the screening is wider than the other conductors.

The cable may include an outer conductor projecting from each of its sides.

BRIEF DESCRIPTION OF THE DRAWINGS

Embodiments of the invention are described by way of example with reference to the accompanying drawings, in which.

DETAILED DESCRIPTION

Figure 1:
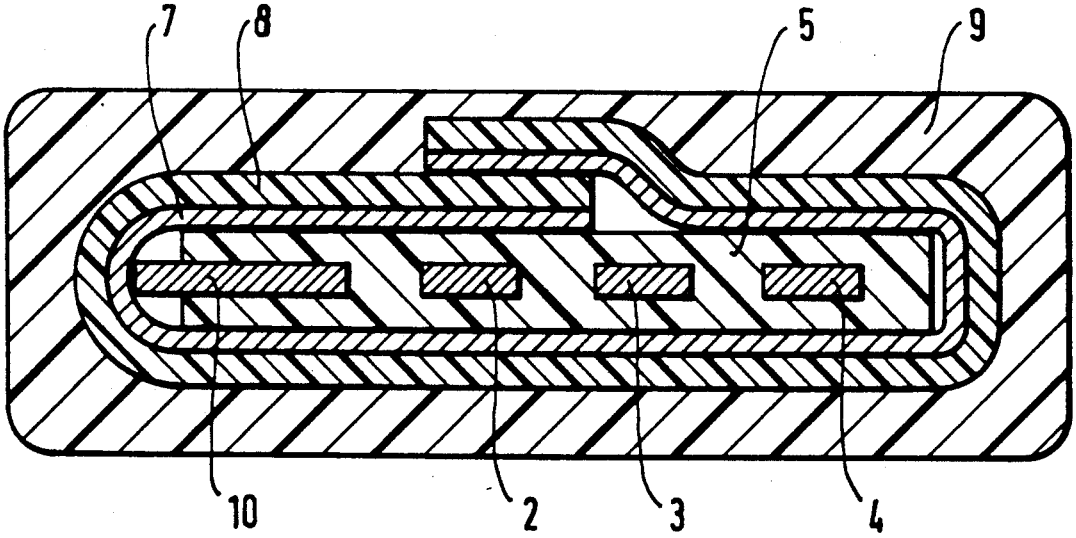
FIG. 1 shows a flat cable in accordance with the invention having an outer conductor projecting from one of its sides, said conductor being wider than the other conductors.

In FIG. 1, the leftmost outer conductor 10 is wider than the other conductors 2, 3, and 4. The conductor spacing remains constant but the conductor 10 projects beyond the insulation 5 and makes contact with the metal foil 7 constituting the screening. It drains the electric charge collected by the screening and thus ensures that it is grounded.

The assembly is surrounded by a metal-coated plastic tape having an aluminum or copper metal foil 7 and a plastic covering 8 made of polyester, polycarbonate, or polyethylene, for example.

The metal-plastic tape is itself embedded in an outer plastic sheath 9.

Such a flat cable enables its screening to be connected to a connection point after the cable has merely been stripped, with the screening being treated in the same way as the other conductors, and with the connection being made by any existing connection system designed for non-screened cable, in particular by crimping using a comb of insulation-piercing contacts, by zero insertion force connectors, by soldered connections on a printed circuit, or by forced insertion connectors.

Figure 2:
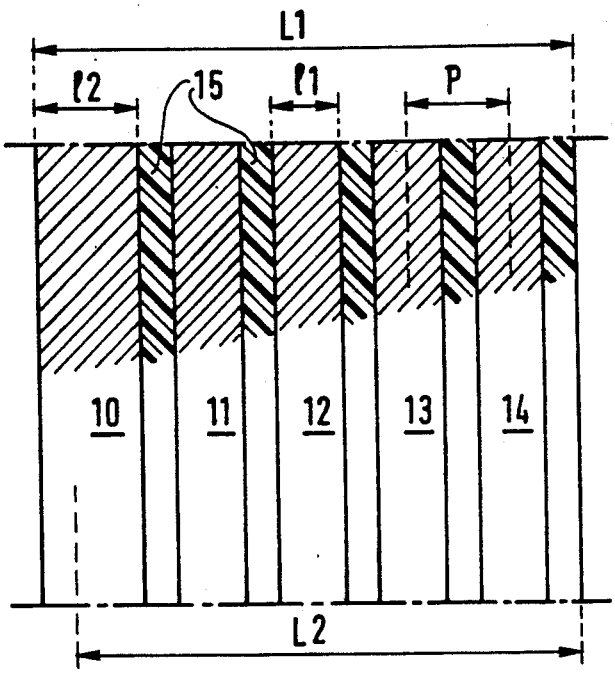
FIG. 2 is a section on a horizontal plane through a flat cable.

In FIG. 2, the flat cable comprises an outer conductor 10 which is wider than the other conductors 11, 12, 13, and 14, and which projects outside the insulation 15. The conductors are at a pitch P, with the identical conductors being of width l1, and the outer conductor 10 being of width $l2>l1$. The total width L1 of the cable is greater than the width L2 of its insulation. The screening which surrounds the insulation and the outer portion of the projecting conductor 10 is not shown.

Figure 3:
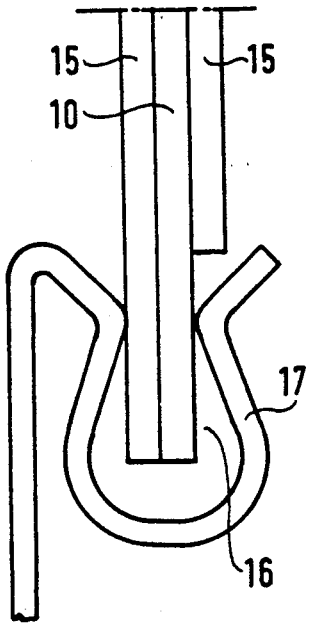
FIG. 3 is a longitudinal view of a zero insertion force contact.

In FIG. 3, the projecting outer conductor 10 of the cable has been stripped of its insulation 15 over a longitudinal zone 16, and a zero insertion force contact 17 has been installed on the stripped zone in contact with the conductor.

Figure 4:
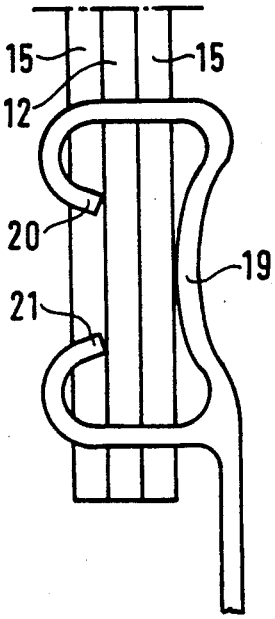
FIG. 4 is a longitudinal view of a longitudinal staple-type contact.

In FIG. 4, which is a longitudinal view, the inner conductor 12 makes a connection via a longitudinal staple-type contact 19 which pierces the insulation 15 and touches the conductor by means of edges 20 and 21.

Figure 5:
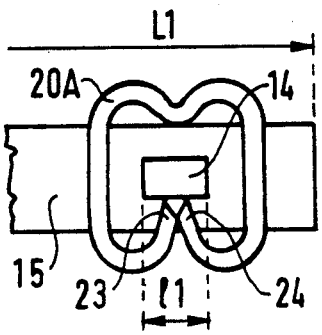
FIG. 5 is a transverse view of transverse staple-type contact.

In FIG. 5, which is a transverse view, the righthand outer conductor 14 which has the same width as the inner conductors has received a transverse staple-type contact 22 piercing the insulation 15 and touching the conductor by means of its edges 23 and 24.

Figure 6:
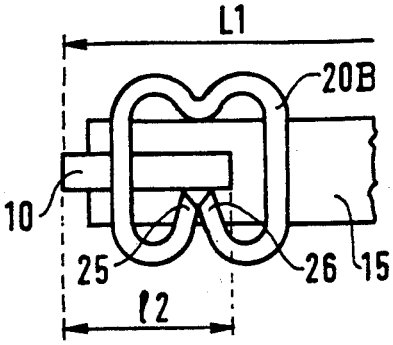
FIG. 6 is a transverse view of different transverse staple-type contact.

FIG. 6 is likewise a transverse view showing the outer conductor 10 which is wider than the others, and provided with a transverse staple-type contact 22 piercing the insulation 15 and touching the conductor along its edges 25 and 26.

I claim:

1. A flat electric cable comprising:

a flat sheath (5) of electrical insulation material, a row of individual, flat, interior conductors (2, 3, 4) embedded within said insulation material sheath (5) at laterally spaced positions such that said row of individual, flat, interior conductors are completely buried within said insulation material sheath, and at least one exterior flat conductor (10), said at least one exterior conductor (10) being of substantially the same thickness to said interior conductors (2, 3, 4) but having a width which is considerably greater than that of any one of said interior conductors, being partially embedded within said insulation material sheath (5) and being spaced from the flat, interior conductor of said row proximate thereto at a distance equal to the distance between consecutive interior conductors of said row, with a side of said at least one exterior, flat conductor (10) projecting exterior beyond a side of said insulation material sheath (5) and being directly contactable with a metallic screen for draining the screen when surrounding said insulation sheath (5).

2. A reinforced cable comprising: a flat sheath (5) of electrical insulation material, a row of individual, flat, interior conductors (2, 3, 4) embedded within said insulation material sheath (5) at laterally spaced positions such that said row of individual, flat, interior conductors are completely buried within said insulation material sheath, and at least one exterior flat conductor (10) capable of draining a metallic screen when surrounding said insulation material sheath (5), said at least one exterior conductor being of substantially the same thickness as that of said interior conductors but having a width which is considerably greater than any one of said interior conductors, being partially embedded within said insulation material sheath (5) and being spaced from the flat, interior conductor of said row proximate thereto, at a distance equal to the distance between consecutive interior conductors of said row, with the side of said at least one exterior, flat conductor (10) projecting exteriorly beyond the side of said insulation material sheath (5);

a metallic foil (7) surrounding said insulation material sheath (5) and in direct contact with the exposed side of said at least one exterior conductor projecting laterally from the sheath, said metallic foil (7) being held by an exterior plastic covering (8); and a protective external insulation material sheath (9) enveloping said exterior plastic covering (8), said metallic foil (7), said inner insulation material sheath (5), said row of individual, flat, interior conductors (2, 3, 4) and said at least one flat exterior conductor (10), whereby said reinforced cable may be connected to a variety of known type connectors having a number of contacts equal to the total number of conductors within said reinforced cable.

* * * * *